US006820950B1

(12) United States Patent
Sun

(10) Patent No.: US 6,820,950 B1
(45) Date of Patent: Nov. 23, 2004

(54) MODULAR CASE FOR HOLDING ARTICLES

(75) Inventor: Chun-Hsia Sun, Changhua Hsien (TW)

(73) Assignee: Ching-Ching Trading Co., Changhua (TW)

( * ) Notice: Subject to any disclaimer, the term of this patent is extended or adjusted under 35 U.S.C. 154(b) by 159 days.

(21) Appl. No.: 10/227,459

(22) Filed: Aug. 26, 2002

(51) Int. Cl.[7] ..... A47B 87/00
(52) U.S. Cl. ..... 312/108; 312/111; 312/263
(58) Field of Search ..... 312/108, 111, 312/257.1, 263, 265.5; 220/4.16, 4.21, 4.28, 4.31; 403/364, 382, 403; 16/386, 316, 312, 314; 52/79.9, 591.1, 270, 591.2

(56) References Cited

U.S. PATENT DOCUMENTS

| | | | | | |
|---|---|---|---|---|---|
| 3,779,448 | A | * | 12/1973 | Wootten | 229/198.2 |
| 3,848,942 | A | * | 11/1974 | Fanini | 312/265.5 |
| 3,856,374 | A | * | 12/1974 | Christen | 312/263 |
| 4,494,275 | A | * | 1/1985 | Hsi-Shan | 16/314 |
| 4,880,284 | A | * | 11/1989 | Dickson et al. | 312/263 |
| 5,133,152 | A | * | 7/1992 | Grancagnolo | 16/314 |
| 5,466,058 | A | * | 11/1995 | Chan | 312/111 |
| 5,888,114 | A | * | 3/1999 | Slocum et al. | 52/591.1 |
| 6,253,520 | B1 | * | 7/2001 | Houk | 52/591.2 |
| 6,557,955 | B2 | * | 5/2003 | Saravis | 312/111 |
| 2002/0109442 | A1 | * | 8/2002 | Hsu | 312/263 |

FOREIGN PATENT DOCUMENTS

| | | | | |
|---|---|---|---|---|
| EP | 245978 | * | 11/1987 | 312/107 |
| EP | 532818 | * | 3/1993 | 312/265.5 |
| JP | 06225815 | * | 8/1994 | 312/265.5 |

* cited by examiner

*Primary Examiner*—Lanna Mai
*Assistant Examiner*—Hanh V. Tran
(74) *Attorney, Agent, or Firm*—Harrison & Egbert

(57) ABSTRACT

A modular case is designed to hold articles and is formed by fitting together various panels of the standardized size and design. The panels are held together by retaining slots and retaining projections. A plurality of shelves are slidably disposed in the V-shaped grooves of the panels. One or more doors are pivoted to the panel by a plurality of pivoting lugs, each having an inclined guide face enabling the doors to swivel automatically. Certain retaining projections and retaining slots are provided with arcuate side walls to enhance the retaining effect. The rear panels have two wavy longitudinal sides to minimize the swaying of two rear panels which are joined together side by side.

2 Claims, 7 Drawing Sheets

MODULAR CASE FOR HOLDING ARTICLES

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to an article-holding case, and more particularly to a modular case which is used to hold articles and is formed by fitting structural units of the standardized size and design.

BACKGROUND OF THE INVENTION

The modular case of the prior art is generally formed of a plurality of panels and shelves, which are fastened together by nuts and bolts. The prior art modular case may be provided with one or more doors, which are fastened by hinges. The assembly of the prior art modular case is done with the help of hand tools and is therefore time-consuming. In addition, the panels are not held together securely and are therefore apt to sway.

BRIEF SUMMARY OF THE INVENTION

The primary objective of the present invention is to provide a modular case which is free of the shortcomings of the prior art modular case described above.

In keeping with the principle of the present invention, the foregoing objective of the present invention is attained by the modular case comprising at least two upright side panels, at least one upright rear panel, at least one top panel, at least one bottom panel, and at least one shelf. The upright side panels are provided in the side wall of two longitudinal ends thereof with a plurality of retaining slots. The upright side panels are further provided in a rear longitudinal side wall with a plurality of retaining projections, and in a front longitudinal side wall with a plurality of pivoting lugs. The upright side panels are further provided in an inner side with a plurality of retaining grooves of a V-shaped cross section. The upright rear panel is provided in an inner side with a plurality of retaining cavities corresponding in location to the retaining projections of the upright side panels. The upright rear panel is further provided in the side wall of two longitudinal ends thereof with a plurality of retaining slots. The upright rear panel has two corrugated longitudinal sides. The top panel and the bottom panel are basically similar in construction to each other and are provided in three side walls with a plurality of retaining projections corresponding in location to the retaining slots of the upright side panels.

The modular case of the present invention is formed by fitting together various panels of the standardized size and design, which include the upright side panels, the upright rear panel, the top panel, and the bottom panel. The various panels are held together by means of retaining projections and retaining slots or cavities. The modular case has a hollow interior which is formed and defined by the upright side panels, the upright rear panel, the top panel, and the bottom panel. The hollow interior can be divided into a plurality of compartments by shelves which are retained in the retaining grooves of the inner sides of the upright side panels.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
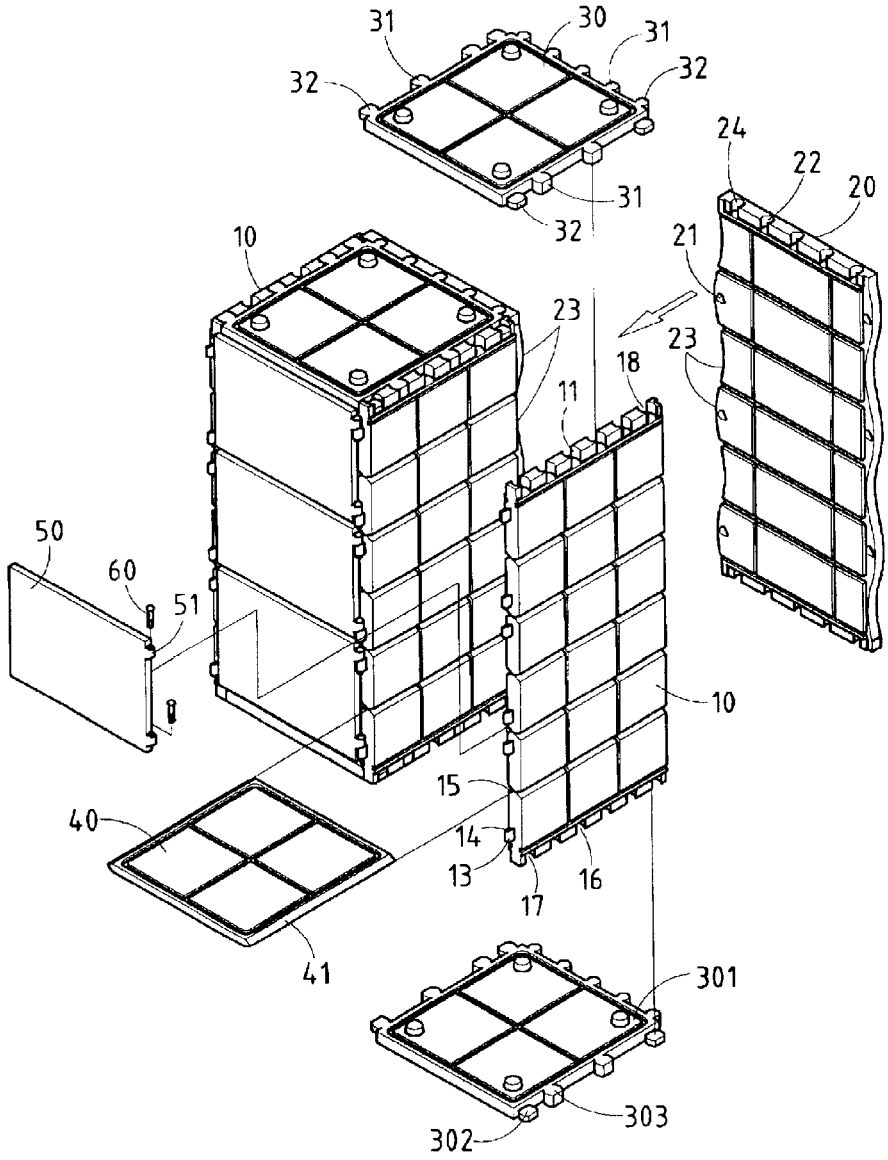
FIG. 1 shows an exploded view of the preferred embodiment of the present invention.
Figure 2:
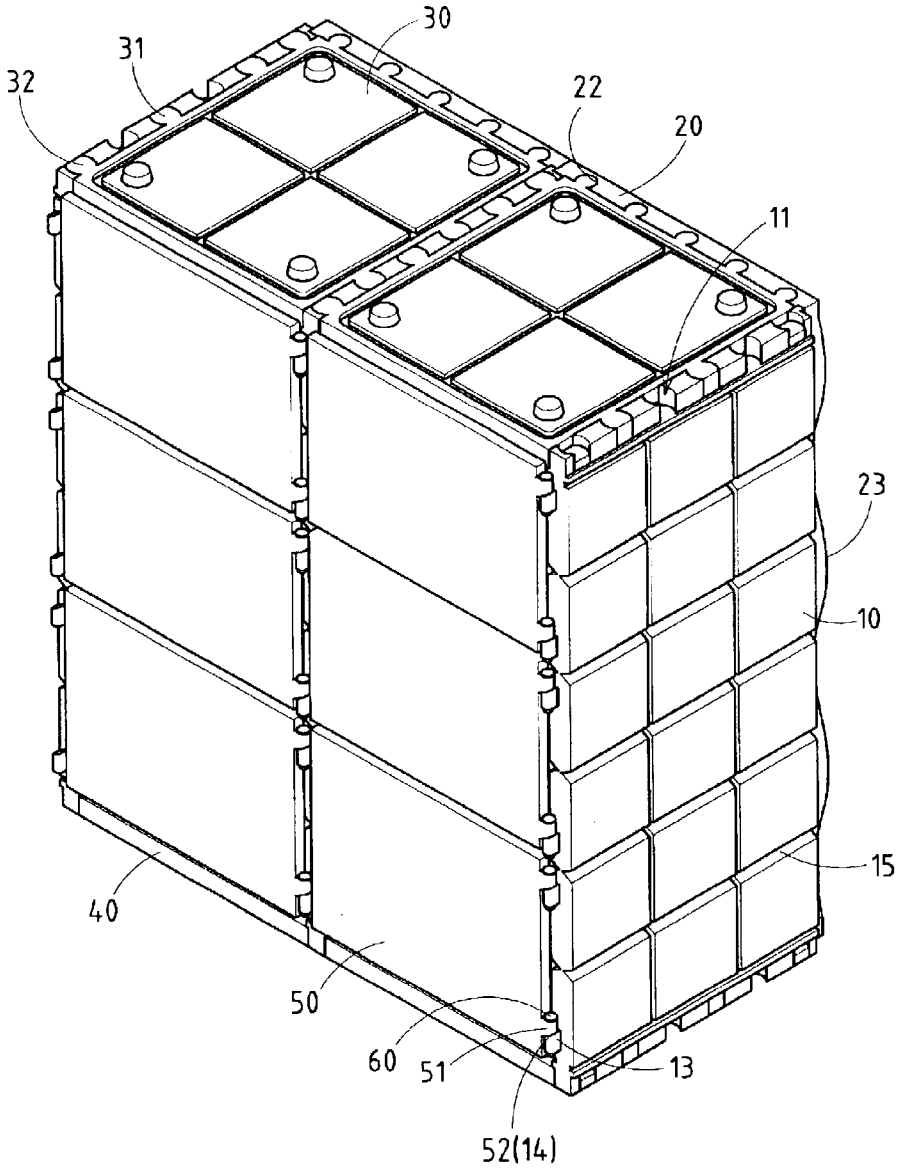
FIG. 2 shows a perspective view of the preferred embodiment of the present invention in combination.

As shown in FIGS. 1–8, a modular case embodied in the present invention is formed of three upright side panels 10, two upright rear panels 20, two top panels 30, two bottom panels 301, a plurality of shelves 40, and a plurality of doors 50.

The upright side panels 10 are identical in construction and dimension. Each upright side panel 10 is provided in the rear longitudinal side wall with a plurality of retaining projections 12 which are arranged at an interval. The upright side panel 10 is provided in the front longitudinal side wall with a plurality of pivoting lugs 13, each being provided at the top thereof with an inclined guide face 14. The upright side panel 10 is provided in two ends of the side wall of the longitudinal top end with a first retaining slot 18. Located between the two first retaining slots 18 are a plurality of second retaining slots 11 arranged at an interval. The upright side panel 10 is provided in two ends of the side wall of the longitudinal bottom end with a first retaining slot 17. Located between the two first retaining slots 17 are a plurality of second retaining slots 16 arranged at an interval.

Figure 5:
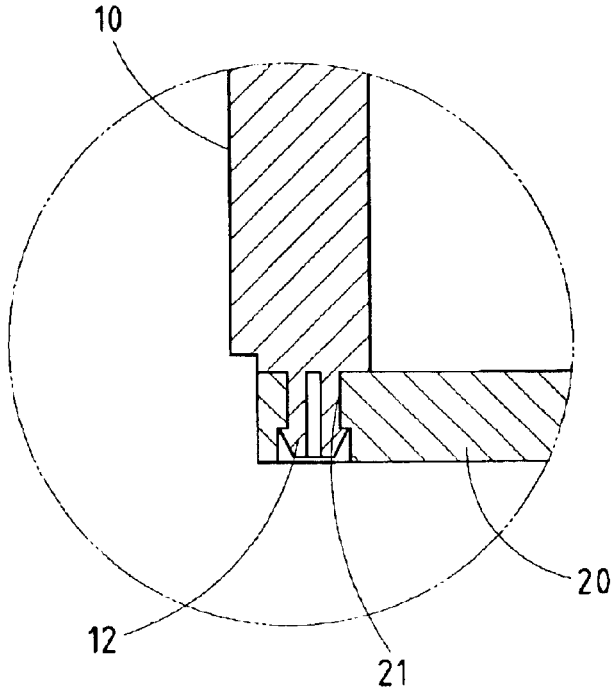
FIG. 5 shows a sectional schematic view of the retaining portions of the upright side panel and the upright rear panel of the preferred embodiment of the present invention.

The two upright rear panels 20 are identical in construction. Each upright rear panel 20 is corresponding in length to the upright side panels 10 and is provided in the two longitudinal side margins of an inner side thereof with a plurality of retaining slots 21 corresponding in location to the retaining projections 12 of the upright side panels 10. The upright rear panel 20 is provided in the side wall of two longitudinal ends thereof with two first retaining slots 24 located at two ends of the side wall, and a plurality of second retaining slots 22 arranged at an interval between the two first retaining slots 24. The upright rear panels 20 are fitted together with the upright side panels 10 such that the retaining projections 12 of the upright side panels 10 are retained in the retaining slots 21 of the upright rear panels 20, as illustrated in FIG. 5.

The two top panels 30 are identical in construction to each other. Each top panel 30 is provided in the side wall of a left side, a right side, and a rear side thereof with two first retaining projections 32 located at two end edges of the side wall, and two second retaining projections 31 located between the two first retaining projections 32. The top panels 30 are fitted with the longitudinal top ends of the upright side panels 10 such that the two first retaining projections 32 are retained in the two first retaining slots 18 of the upright side panels 10, and that the two second retaining projections 31 are retained in the second retaining slots 11 of the upright side panels 10.

The two bottom panels 301 are identical in construction to each other and to the top panels 30. Each bottom panel 301 is provided in the side wall of a left side, a right side, and a rear side thereof with two first retaining projections 302 located at two end edges of the side wall, and two second retaining projections 303 located between the two first retaining projections 302. The bottom panels 301 are fitted with the longitudinal bottom ends of the upright side panels 10 such that the two first retaining projections 302 are retained in the two first retaining slots 17 of the upright side panels 10, and that the two second retaining projections 303 are retained in the second retaining slots 16 of the upright side panels 10.

Figure 6:
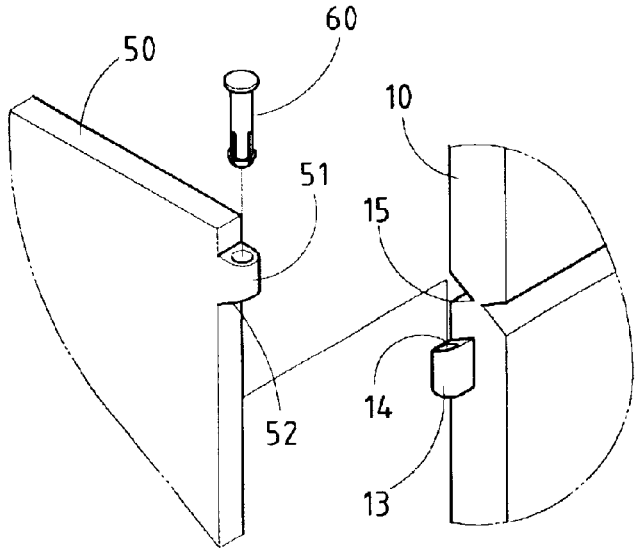
FIG. 6 shows an exploded view of a door and an upright side panel of the preferred embodiment of the present invention.
Figure 7:
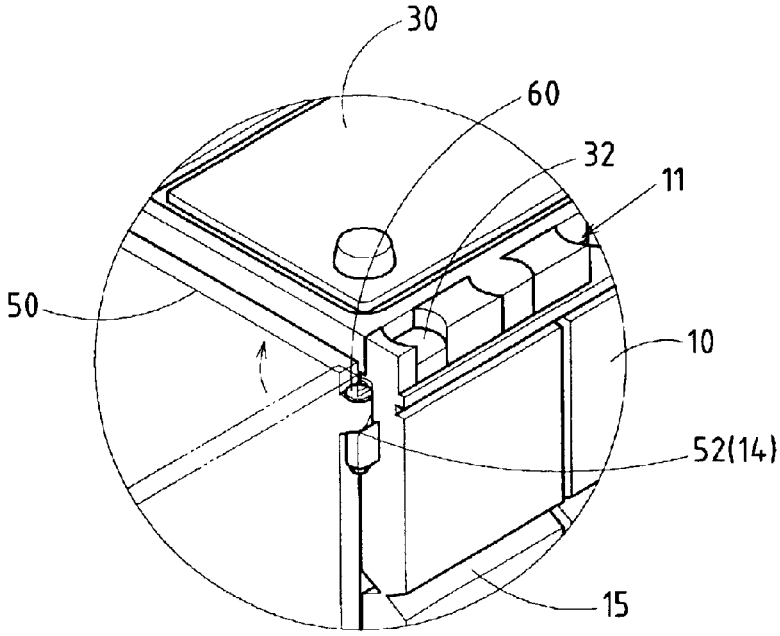
FIG. 7 shows a partial enlarged view of the pivoting of the door of the preferred embodiment of the present invention.

The modular case of the present invention is provided with a hollow interior which is formed and defined by two upright side panels 10, one upright rear panel 20, the top panel 30, and the bottom panel 301. The hollow interior can be divided into a plurality of compartments by means of a plurality of shelves 40, each having two retaining edges 41 opposite to each other and having a V-shaped cross section. The inner side of the upright side panels 10 is provided with a plurality of grooves 15, which are arranged at intervals and have a V-shaped cross section. The retaining edges 41 of the shelves 40 are slidably received in the grooves 15 of the upright side panels 10. The V-shaped retaining edges 41 of the shelves 40 and the V-shaped grooves 15 of the upright side panels 10 serve to increase contact area between the shelves 40 and the upright side panels 10, thereby enhancing the loading capacity of the shelves 40. The compartments may be provided with a door 50, which is provided with two pivoting lugs 51. The door 50 is pivoted to the upright side panels 10 by two pivots 60 which are put through the pivoting lugs 51 of the door 50 and the pivoting lugs 13 of the upright side panels 10, as shown in FIGS. 6 and 7. The pivoting lugs 51 of the door 50 are provided with an inclined guide face 52, which comes in contact with the inclined guide face 14 of the pivoting lug 13 of the upright side panel 10. By virtue of the guiding actions of the inclined guide faces 14 and 52, the pivoting end of the door 50 is bound to swivel in a direction toward the upright side panels 10, thereby causing the door 50 to close the compartment automatically time after time.

Figure 3:
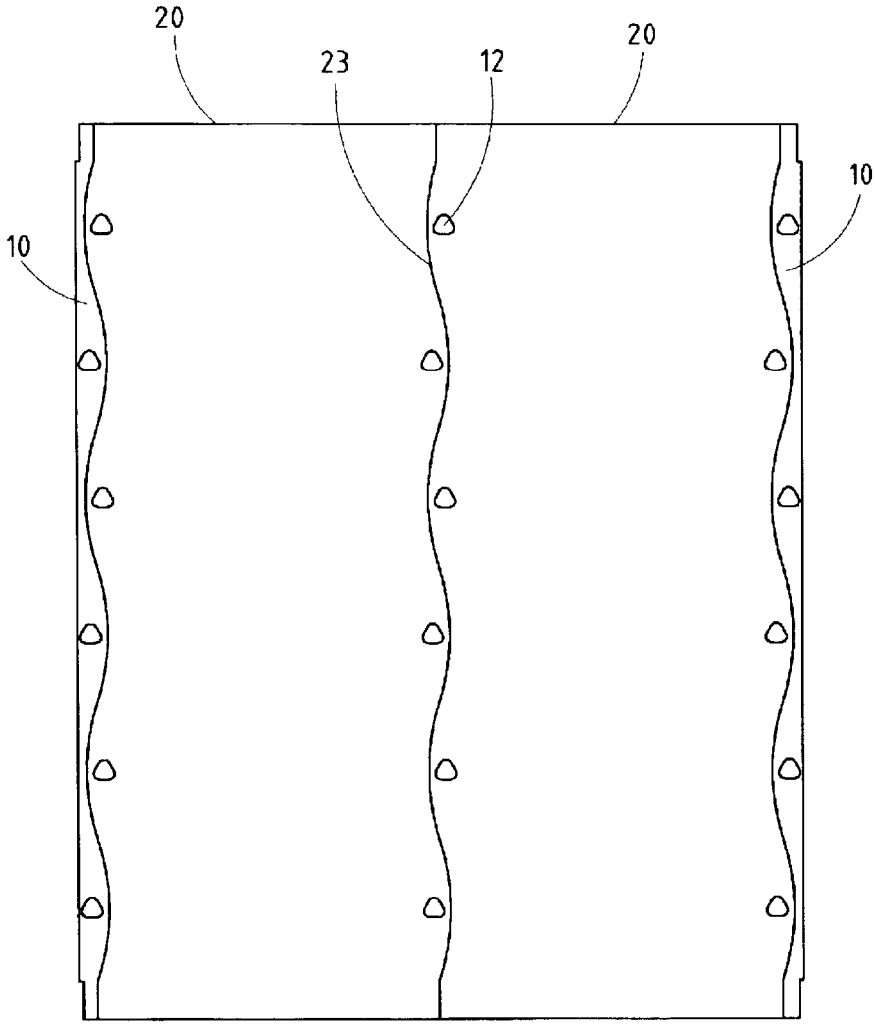
FIG. 3 shows a schematic plan view of the rear of the preferred embodiment of the present invention.
Figure 4:
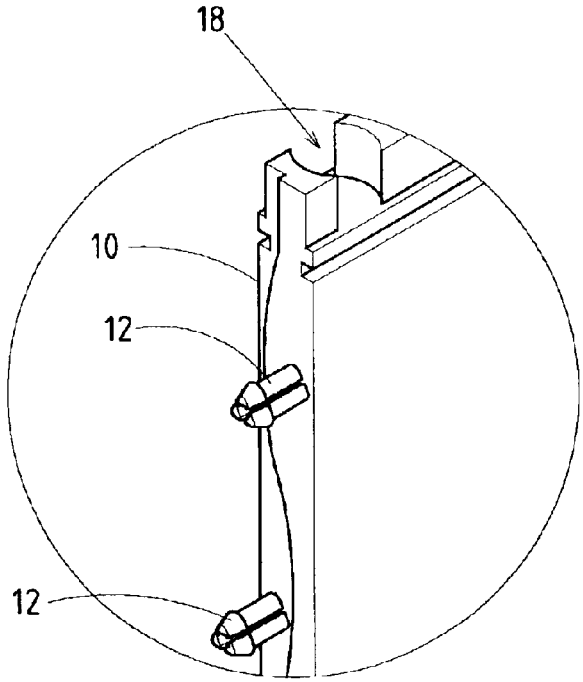
FIG. 4 shows a partial enlarged view of the side wall of the rear longitudinal side of the upright side panels of the preferred embodiment of the present invention.

The upright rear panels 20 are provided with two wavy longitudinal sides 23. When two upright rear panels 20 are joined together side by side, the two wavy longitudinal sides 23 match perfectly, as shown in FIG. 3. The wavy longitudinal sides 23 serve to avert the swaying of the upright rear panels 20.

Figure 8:
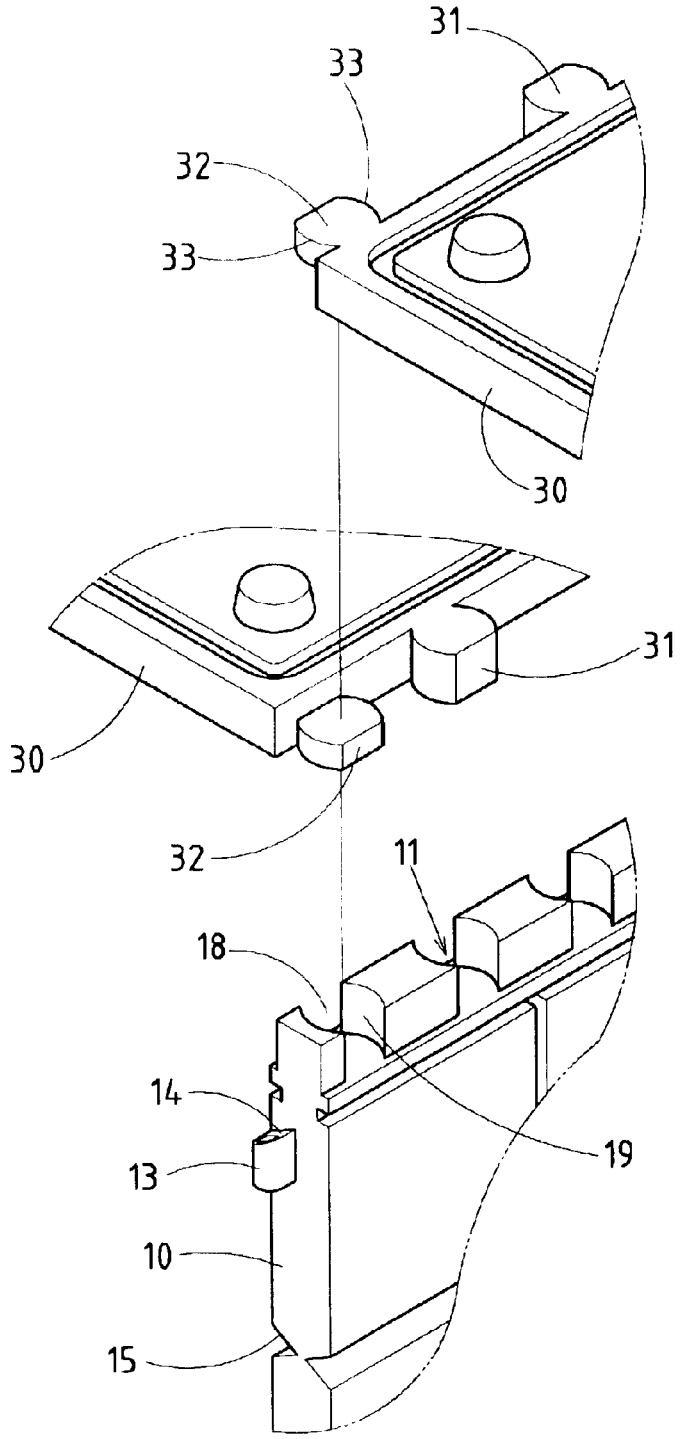
FIG. 8 shows a partial exploded view of the top panel and the upright side panel of the preferred embodiment of the present invention.

As shown in FIG. 8, the first retaining projections 32 of the top panels 30 are provided with two arcuate side walls 33. The first retaining projection 32 is retained in the first retaining slot 18 of the upright side panel 10 such that the arcuate side walls 33 of the first retaining projection 32 come in contact with two arcuate side walls 19 of the first retaining slot 18 of the upright side panel 10. The engagement of the arcuate side walls can hold more securely the first retaining projection 32 and the first retaining slot 18 together as compared with an engagement of the straight side walls.

Figure 9:
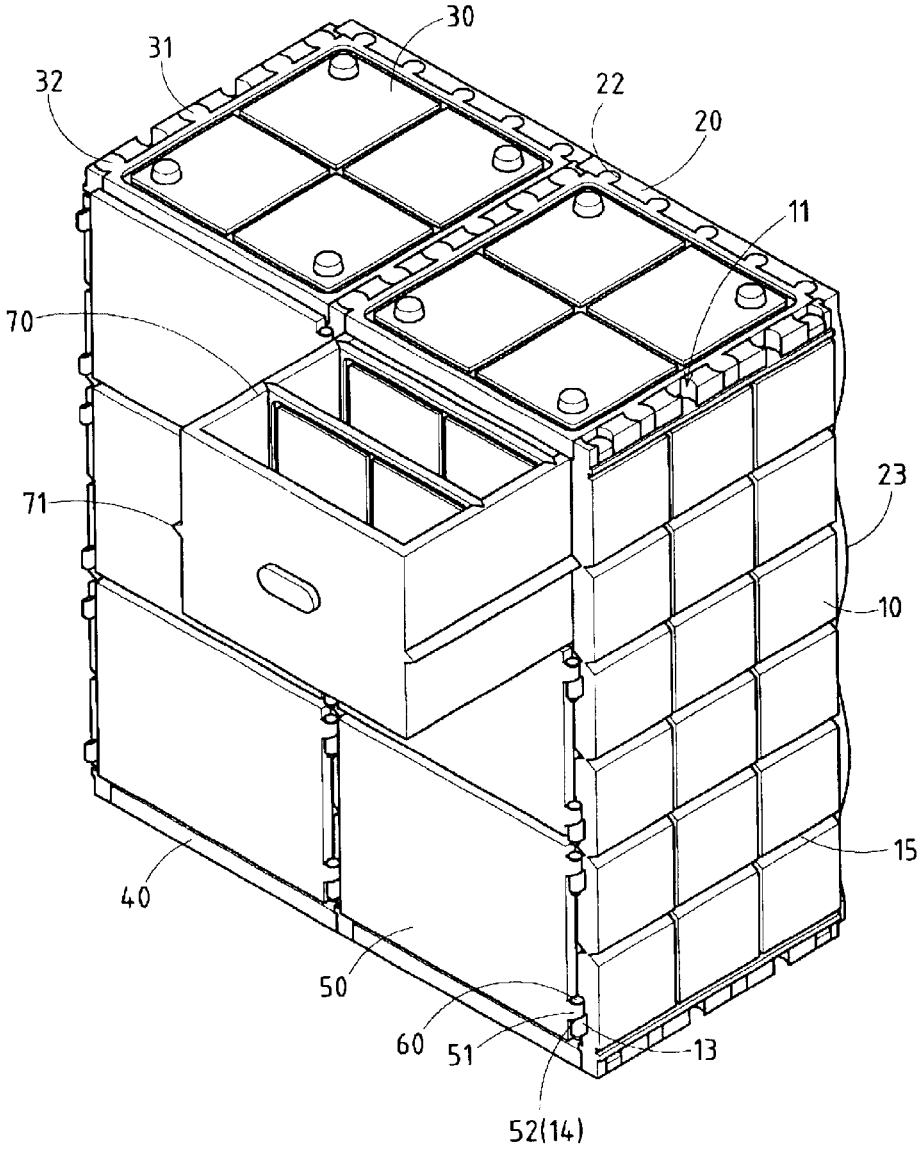
FIG. 9 shows a schematic view of a drawer of the preferred embodiment of the present invention.

As shown in FIG. 9, the preferred embodiment of the present invention further comprises at least one drawer 70, which is provided in two outer side walls with a rib 71 having a V-shaped cross section and corresponding to the V-shaped grooves 15 of the upright side panels 10. The drawer 70 is disposed between the two shelves 40 such that the ribs 71 are slidably received in the grooves 15 of the upright side panels 10.

The embodiment of the present invention described above is to be regarded in all respects as being illustrative and nonrestrictive. Accordingly, the present invention may be embodied in other specific forms without deviating from the spirit thereof. The present invention is therefore to be limited only by the scopes of the following claims.

I claim:

1. A modular case for holding articles comprising:

at least three upright side panels of a geometric form and identical in construction and in dimension, each of the upright side panels having a plurality of retaining projections in a rear longitudinal side wall thereof and a plurality of retaining slots in a longitudinal top end wall and a longitudinal bottom end wall thereof, each of the upright side panels having a plurality of grooves arranged at intervals in an inner side thereof, each of the upright side panels having a plurality of pivoting lugs arranged at intervals in a front longitudinal side wall thereof;

at least two upright rear panels identical in geometric form to said upright side panels and identical in construction to each other, the upright rear panels having a plurality of retaining slots in two longitudinal side margins at an inner side thereof corresponding in location to the retaining projections of the rear longitudinal side wall of the upright side panels, the upright rear panels further having a plurality of retaining slots in a longitudinal top end wall and a longitudinal bottom end wall thereof, each of the upright rear panels is fitted to two of said upright side panels such that the retaining projections of the rear longitudinal side walls of the two upright side panels are retained respectively in the retaining slots of the two longitudinal side margins of the inner side of the upright rear panel;

at least two top panels of a geometric form and identical in construction to each other, the top panels having a plurality of retaining projections in three side walls thereof corresponding in location to the retaining slots of the longitudinal top end wall of the upright side panels and the retaining slots of the longitudinal top end wall of the upright rear panels, each of the top panels being fitted to two of the upright side panels and to one of the upright rear panels such that the retaining projections of said top panel are retained respectively in the retaining slots of the longitudinal top end walls of the upright side panels and the retaining slots of the longitudinal top end wall of the upright rear panel;

at least two bottom panels identical in geometric form to the top panels, the bottom panels being identical in construction to each other, the bottom panels having a plurality of retaining projections in three side walls thereof corresponding in location to the retaining slots of the longitudinal bottom end wall of the upright side panels and the retaining slots of the longitudinal bottom end wall of the upright rear panels, each of the bottom panels being fitted to two of said upright side panels and to one of the upright rear panels such that the retaining projections of the bottom panel are respectively retained in the retaining slots of the longitudinal bottom end walls of the upright side panels and the retaining slots of the longitudinal bottom end wall of the upright rear panel;

a plurality of shelves slidably disposed in said grooves of said upright side panels; and at least one door having a plurality of pivoting lugs at one end thereof and fastened pivotally with one of the upright side panels such that the pivoting lugs of the door are pivoted with the pivoting lugs of the upright side panels, each of said grooves of the upright side panels having a V-shaped cross section, said plurality of shelves having a retaining edge in opposite sides thereof corresponding in cross section to said grooves, the retaining edges of said shelves being slidably disposed respectively in said grooves, each of said plurality of pivoting lugs of the upright side panels having an inclined guide face, said pivoting lugs of the door having an inclined guide face, the doors being pivoted to the upright side panels such that said inclined guide face of the pivoting lugs of the door contacts the inclined guide face of the pivoting lugs of the upright side panels so as to urge the door to swivel automatically toward the upright side panels, each of the upright rear panels having two wavy longitudinal sides on opposite sides thereof, the retaining projections of the top panels having two arcuate side walls opposite to each other, the retaining slots of the longitudinal top end wall of the upright side panels having two arcuate side walls opposite to each other, the retaining projections of the top panels being retained respectively in the retaining slots of the longitudinal top end wall of the upright side panels such that the arcuate side walls of the retaining projections are in contact with the arcuate side walls of the retaining slots.

2. The modular case of claim 1, further comprising:

at least one drawer having a rib in two opposite outer side walls corresponding in cross section and location to said grooves of the upright side panels, the drawer being disposed between two of the shelves such that the ribs of the drawer are respectively slidably received in said grooves of the upright side panels.

* * * * *